US006793099B1

(12) United States Patent
Sleiman

(10) Patent No.: US 6,793,099 B1
(45) Date of Patent: Sep. 21, 2004

(54) SUPPLY SYSTEM FOR A BOTTLED WATER COOLER AND METHOD OF USE

(76) Inventor: Ali Ahmed Sleiman, 4555 Brompton Ave., Bell, CA (US) 90201

( * ) Notice: Subject to any disclaimer, the term of this patent is extended or adjusted under 35 U.S.C. 154(b) by 0 days.

(21) Appl. No.: 10/356,799

(22) Filed: Feb. 3, 2003

(51) Int. Cl.[7] ..... B67D 5/08

(52) U.S. Cl. ..... 222/67; 222/1; 222/66; 222/146.1; 141/198; 62/389

(58) Field of Search ..... 222/64–67, 56, 222/61.1, 146.1, 146.2, 146.6, 129.1, 185.1; 62/389–391; 141/198, 323

(56) References Cited

U.S. PATENT DOCUMENTS 3,495,612 A * 2/1970 Moreland, II et al. ..... 137/209
4,030,634 A * 6/1977 Osborn ..... 222/23
4,174,743 A * 11/1979 Beny et al. ..... 141/18
4,830,223 A * 5/1989 Priest ..... 222/146.6
4,958,747 A * 9/1990 Sheets ..... 222/67
5,003,790 A * 4/1991 Goupil ..... 62/389
5,042,689 A * 8/1991 Mrugala et al. ..... 222/66
5,048,754 A * 9/1991 Rich ..... 239/13
5,495,725 A * 3/1996 Middlemiss ..... 62/389
5,540,355 A * 7/1996 Hancock et al. ..... 222/56
5,992,684 A * 11/1999 Russell ..... 222/1
6,056,154 A * 5/2000 Fowler ..... 222/1
6,453,955 B1 * 9/2002 Lee ..... 141/198

FOREIGN PATENT DOCUMENTS

GB 2268925 A * 1/1994 ..... B67D/1/00

* cited by examiner

*Primary Examiner*—Kenneth Bomberg
*Assistant Examiner*—Frederick C. Nicolas
(74) *Attorney, Agent, or Firm*—Timothy Thut Tyson; Ted Masters; Freilich, Hornbaker & Rosen

(57) ABSTRACT

A supply system for providing water from a bottled water cooler includes a pump which pumps water from an upright bottle of water. A pressure sensor turns the pump off when the bottle of water is empty. A prime pump control starts the pump to initiate the flow of water from a new bottle of water.

7 Claims, 6 Drawing Sheets

20
44
40
42
500
32
508
512
504
502
22
24
600

SUPPLY SYSTEM FOR A BOTTLED WATER COOLER AND METHOD OF USE

TECHNICAL FIELD

The present invention pertains generally to bottled water coolers, and more particularly to a water supply system which allows the bottle of water to be located on the floor adjacent the bottled water cooler rather than in the conventional inverted position on top of the bottled water cooler.

BACKGROUND OF THE INVENTION

Water cooler systems which allow the bottle of water to be placed on the floor rather than on top of the water cooler are well known in the art. For example, U.S. Pat. No. 6,155,460 shows a pump and regulator which are combined with a pump and water bottle. The device operates on low voltage and contains a sensor which turns the pump off when the water bottle is empty. The device further includes a regulator which controls the level of water in the dispensing water reservoir U.S. Pat. No. 6,056,154 illustrates a fluid dispensing system for receiving fluid from a container positioned near the ground and for transporting the water up to a water reservoir suitable for dispensing. The water reservoir has a spigot. A sensor detects a predetermined fluid level in the water reservoir, and a temperature adjuster maintains the fluid at a predetermined temperature range. The system has a pump for transporting fluid from the container to the water reservoir and a circuit connected to the pump and to the sensor for activating the pump when fluid in the water reservoir falls below the predetermined fluid level. The device operates on 12 or 24 VDC. A timer is used to indicated when the water bottle is empty.

U.S. Pat. No. 5,901,880 discloses a bottled water delivery system which includes a pump which moves water from a bottle to a desired output location. Heavy water bottles need not be moved and may be located at a significant preselected distance from the output location. A controller is provided to keep the pump from being actuated when there is no water available for pumping. A float indicates when the water bottle is empty.

U.S. Pat. No. 5,638,991 shows a bottled water dispenser having an upright five gallon bottle on a dolly. The dolly with bottle is wheeled into the bottom of the dispenser. A tube with a rubber stopper at one end and a check valve at the other end is inserted into the bottle. A button on the face plate of the dispenser cabinet is pushed to activate an internal electric pump. The pump draws water from the bottle through the check valve and forces it out of the spigot under pressure. Internal solenoid valves direct the water through a heating unit, cooling unit or filtration system before exiting through the spigot. A desired temperature is obtained by selecting a particular colored button on the face plate. The dispenser operates on 240 V AC, 120 V AC or 12 VDC. It has a built in auxiliary battery back up for portable use or in the event of power outages.

U.S. Pat. No. 5,540,355 consists of a water cooler and dispensing system having a housing, a pump, a cap, a siphon tube, a water reservoir, a cooling unit, control circuitry, and a faucet. The housing supports the water reservoir above a water bottle. The cap seals the bottle and is coupled to the pump. The pump directs air into the bottle and water upward through the siphon tube to the water reservoir. A liquid pumping system may also be used. The water reservoir is divided into two portions. The lower portion contains a cooling unit for chilling the water. The water reservoir has an output port from each portion of the water reservoir coupled to a faucet. The dispenser has control circuitry for selectively operating the pump to maintain a predetermined water level in the water reservoir. The controller lights an indicator when the bottle is empty.

U.S. Pat. No. 5,495,725 describes a water transport system which replaces the inverted water bottle on a conventional bottled water cooler. The system automatically transfers water from an upright water bottle below the water reservoir into the water reservoir whenever water in the water reservoir falls below a predetermined level. A water pipe carries water from the bottle, through a sealed closure in the bottle neck and up into the water reservoir whenever air pressure in the bottle is elevated. An air pump in a housing atop the water reservoir generates air pressure in an air tube passing through the closure and into the bottle. A water level sensor reduces air pressure in the system when the water in the water reservoir reaches a predetermined level to thereby automatically control refilling of the water reservoir.

U.S. Pat. No. 4,958,747 shows a bottled water dispenser. A pump suctions water from the upright bottle and transmits it to a first water reservoir positioned at the uppermost portion of the dispenser. The device has both ambient and cold water reservoirs and spigots for each. A sensor indicates the level of water in the dispensing water reservoir.

U.S. Pat. No. 4,153,181 is directed to a unit for dispensing water from a bottle. The parts of the unit include an air pump for pressurizing the bottle, a microswitch having a control button connected in circuit with the pump, a small pressure chamber with a distensible diaphragm for a top, a branched air line connecting the pump with the bottle and the pressure chamber, and a cabinet with rollers that can be rolled to a position of use around the upright bottle. A water line extends upwardly away from the bottle. A rubber cap encloses the bottle opening, the water line, and a branch of the air line that passes into the interior of the bottle. Fastened to the lower end of the metal tube for the water line is a section of flexible tubing long enough to reach to the bottom of the bottle. The microswitch is normally closed and the pressure chamber is positioned with its diaphragm close to the control button of the switch. When the air pressure in the bottle exceeds a certain limit, the diaphragm bulges outwardly into contact with the button and opens the microswitch. When water is drawn from the bottle through the water line, the air pressure drops, and the diaphragm shrinks away from the control button. This causes the microswitch to close and start the air pump operating to again build up air pressure in the bottle. The pump will automatically shut off is there is no water in the bottle.

U.S. Pat. No. 4,030,634 shows a device for transferring water from a standard five gallon water bottle to a dispenser spout, without the need for lifting the bottle and inverting it atop the dispenser. The devise includes a pump, ducting to carry water from the bottle to the dispenser, and various control sensor and indicator means to control pressure and water flow so that potable water from the dispenser is available on demand. The device has a water reservoir water level sensor and control.

U.S. Pat. No. 3,495,612 illustrates a water pumping and control system for a bottled water cooler apparatus where the supply is located below a cooling chamber. The water is forced from the supply bottle up to the cooling chamber by a pump until the desired water level is reached in the cooling chamber.

SUMMARY OF THE INVENTION

The present invention is directed to a supply system and method for dispensing water from a bottled water cooler. The system utilizes a bottle of water which is placed in an upright position adjacent the bottled water cooler rather than in the conventional inverted position on top of the bottled water cooler. There is no need to pick up the bottle of water and place it on top of the bottled water cooler. The present invention is intended to benefit those individuals who are unable to handle the heavy bottle of water.

The supply system employs an automatic demand pump which pumps water from the upright bottle of water and into the water reservoir of the bottled water cooler. The pump is safe in that it runs off of 12 VDC power. The system includes a pressure sensor which turns the pump off when the bottle of water is empty so that the pump will not continue to pump air. The system further includes a prime pump control which initiates the flow of water from a new bottle of water.

The supply system may be conveniently added to existing bottled water coolers, by placing a housing which contains components of the supply system on top of the bottled water cooler. Alternatively, the supply system may be integrated into the bottled water cooler design.

In accordance with a preferred embodiment of the invention, a supply system for a bottled water cooler is provided. The bottled water cooler includes a bottle of water residing in an upright position, a water reservoir, and at least one faucet connected to the water reservoir. The supply system includes a hollow member, such as an elongated tube, pipe, or hose, which is placed in the bottle of water. The input of a pump is connected by a hose to the hollow member. The output of the pump is connected by a tube to the water reservoir. A pressure sensor is connected to the tube, wherein the pressure sensor senses the water pressure in the tube. When the bottle of water is empty, the pump begins pumping air instead of water, and the pressure sensor senses this lower pressure and causes the pump to turn off.

In accordance with an aspect of the invention, a prime pump control overrides the pressure sensor and turns the pump on, thereby allowing a full bottle of water to be connected to the supply system.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
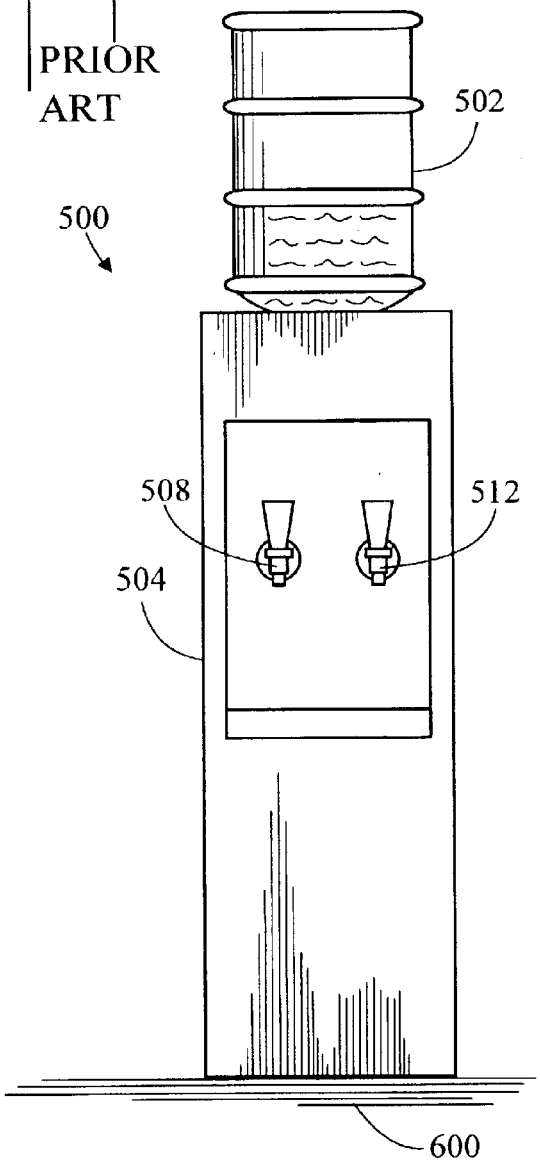
Fig. 1 PRIOR ART
FIG. 1 is a front elevation view of a prior art bottled water cooler.
Figure 2:
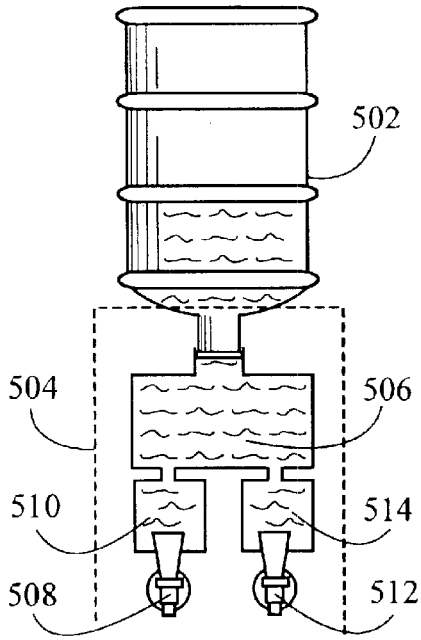
Fig. 2 PRIOR ART
FIG. 2 is a front elevation view of water flow within the prior art water cooler.

FIGS. 1 and 2 illustrate, respectively, a front elevation view of a prior art water cooler 500 and a front elevation view of water flow within the prior art water cooler. Bottled water cooler 500 includes a bottle of water 502 which is placed in an inverted position on top of the housing 504 of the bottled water cooler 500. The water in bottle 502 is fed by gravity into a water reservoir 506. Water reservoir 506 supplies a chilled water faucet 508 via a chilling unit 510, and supplies a heated water faucet 512 via a heating unit 514.

Figure 3:
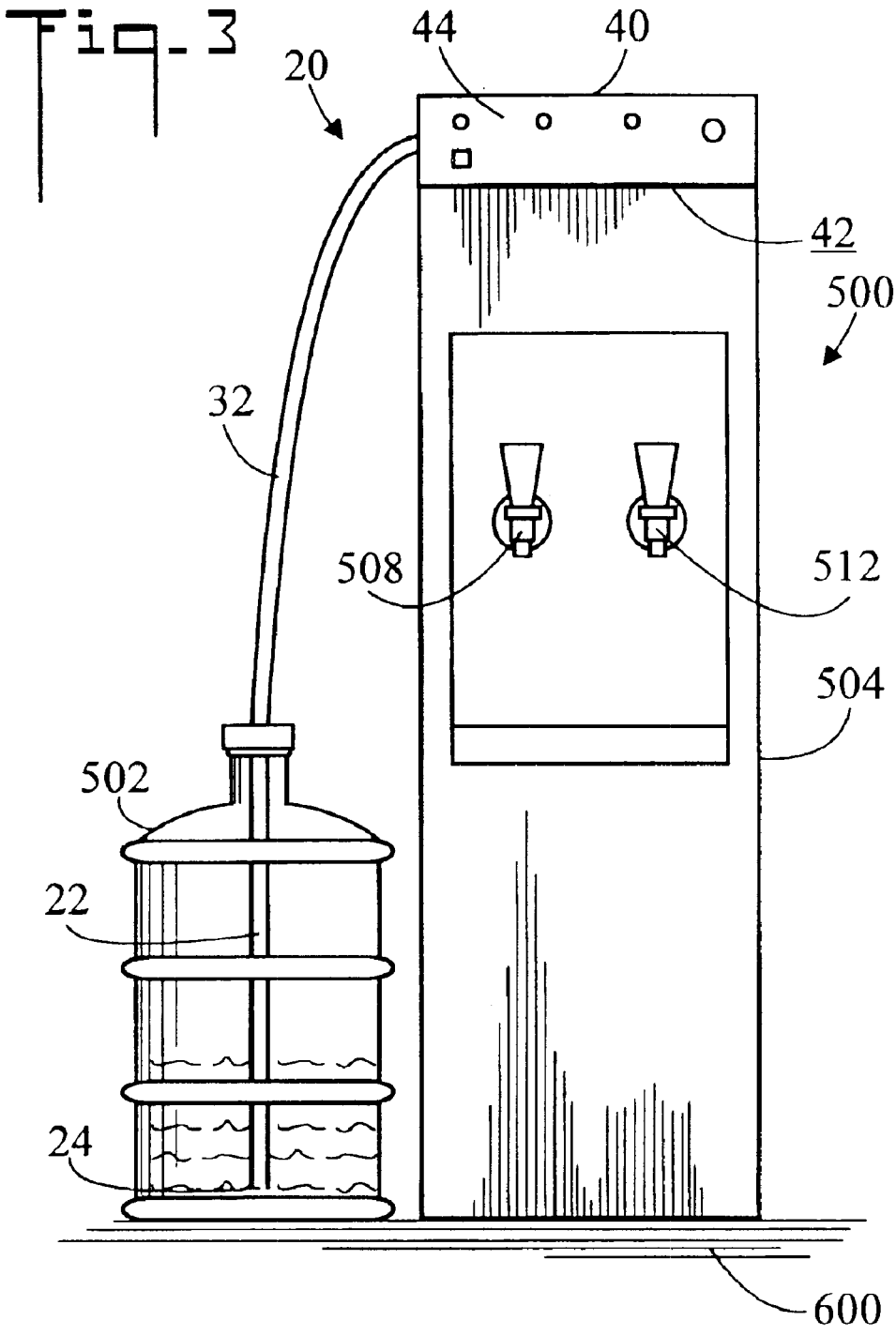
FIG. 3 is a front elevation view of a supply system for a bottled water cooler in accordance with the present invention.
Figure 4:
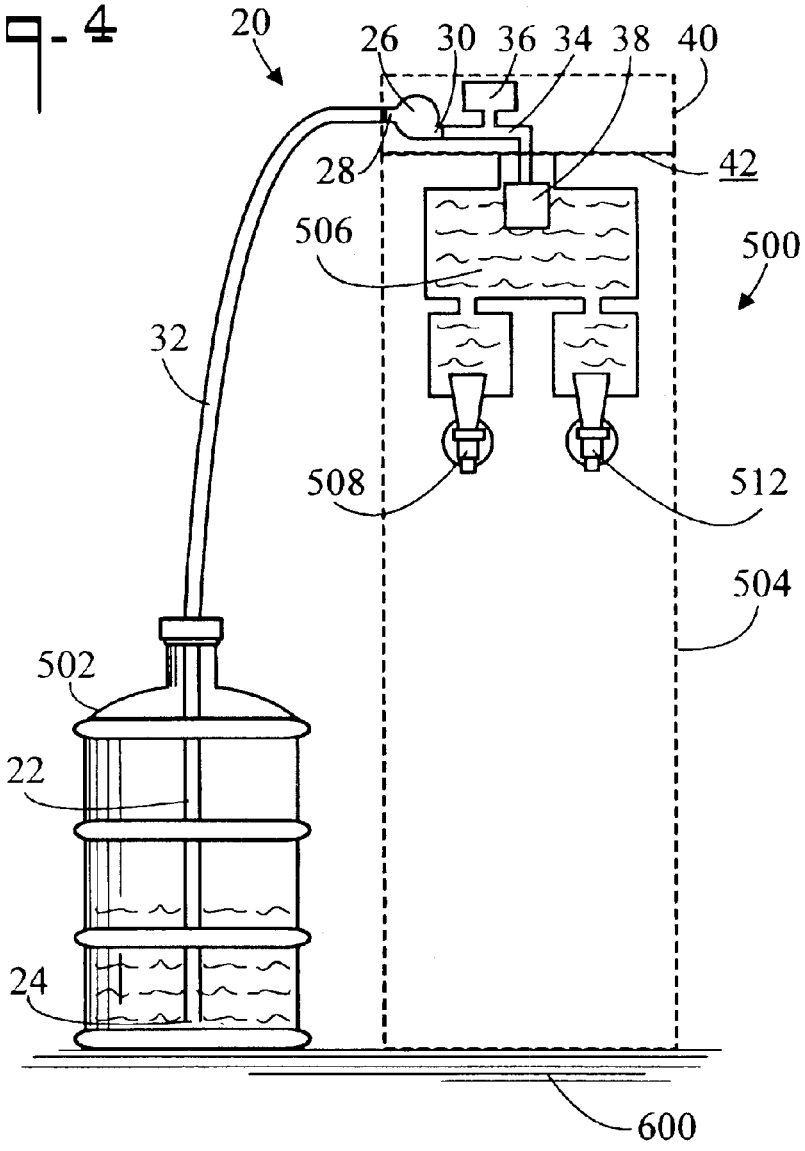
FIG. 4 is a front elevation view of water flow within the supply system.

FIGS. 3 and 4 illustrate, respectively, a front elevation view of a supply system for a bottled water cooler 500 in accordance with the present invention, generally designated as 20, and a front elevation view of water flow within supply system 20. It is noted that in the present invention, the bottle of water 502 is not placed in an inverted position on top of the housing 504 of the bottled water cooler 500, but rather resides in an upright position adjacent and on the same support surface 600 as the housing 504 of the bottled water cooler 500. Supply system 20 includes a hollow member 22 (such as a tube) for removing water from the bottle of water 502. Hollow member 22 is inserted into the top of bottle of water 502 so that an open end 24 is positioned near the bottom of bottle of water 502. A pump 26 has an input 28 and an output 30. Input 28 is connected via hose 32 to hollow member 22. Output 30 is connected by a tube 34 to the water reservoir 506. Pump 26 pumps water from water bottle 502, and delivers it to water reservoir 506. In a preferred embodiment of the invention, pump 26 is an automatic demand pump which will pump water unless the pump 26 output 30 is blocked. That is, when there is no downstream exit for the water. When output 30 is blocked, pump 26 will maintain water pressure in tube 34.

Supply system 20 further includes a water level sensor 38 which is connected to water reservoir 506. When a predetermined water level is attained in the water reservoir 506, water level sensor 38 blocks water flow from the output 30 of pump 26 to the water reservoir 506. Water level sensor 38 operates similar to a ball-cock mechanism in a tank toilet, and in fact, a ball-cock mechanism can be utilized in the present invention.

A pressure sensor 36 is connected to tube 34, wherein pressure sensor 36 senses the pressure in tube 34. When pump 26 is on, pump 26 maintains water pressure in tube 34. However, when the bottle of water 502 is empty, pump 26 pumps air into tube 34 thereby lowering the pressure in tube 34. Pressure sensor 36 senses this low pressure and causes pump 26 to turn off. Turning pump 26 off when there is no water in bottle 502 avoids the noise associated with the pumping of air, and also prolongs the life of pump 26.

Pump 26, tube 34, and pressure sensor 36 are all disposed in a housing 40 having a bottom surface 42. In a preferred embodiment of the invention, housing 40 is placed on top of housing 504 of bottled water cooler 500. Housing 40 also includes a control panel 44 which includes supply system 20 controls and indicators (also refer to FIG. 5). In an embodiment of the invention, at least one level interlock 46 (refer to FIG. 8) is disposed on bottom surface 42 of housing 40, so that if bottom surface 42 is not residing on a support surface (such as the top of housing 504), interlock 46 will cause pump 26 to turn off. This feature prevents water spills should housing 40 be tilted so that tube 34 disconnects from water reservoir 506. In an embodiment of the invention, a plurality of level interlocks 46 connected in series are provided. By providing a plurality of level interlocks 46 located on different portions of bottom surface 42, tilting of housing 40 in various directions will result in pump 26 being turned off.

Figure 5:
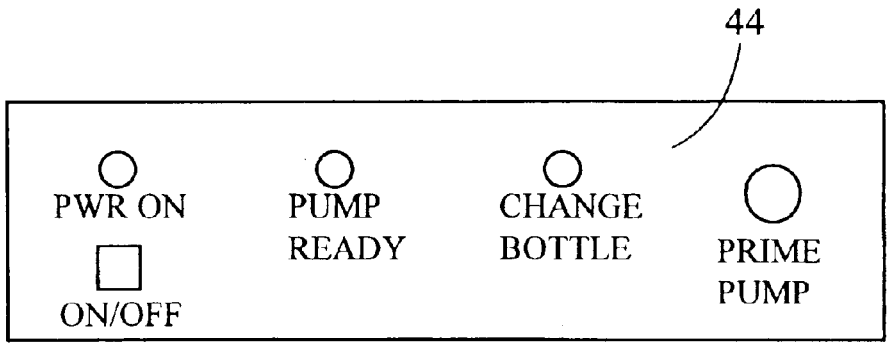
FIG. 5 is an enlarged view of a control panel of the supply system.

FIG. 5 is an enlarged view of control panel 44 of supply system 20. Control panel includes an on/off alternate action control, and an associated power on indicator (LED). A pump ready indicator (LED) illuminates when power is applied to pump 26. Control panel 44 also includes a blinking change bottle indicator (blinking LED). When bottle of water 502 is empty, pressure sensor 36 senses low pressure in tube 34, and actuates a relay which in turn illuminates the blinking change bottle indicator. Control panel 44 also includes a prime pump control. The prime pump control is a spring loaded switch, which when activated directly turns on pump 26. This feature is used to override the low pressure condition which exists when a new water bottle 502 replaces an empty water bottle 502. When a new water bottle 502 is installed, the user presses and holds the prime pump control until the blinking change bottle indicator goes out and the pump ready indicator comes on. This action primes supply system 20 with water so that normal operation may resume.

Figure 6:
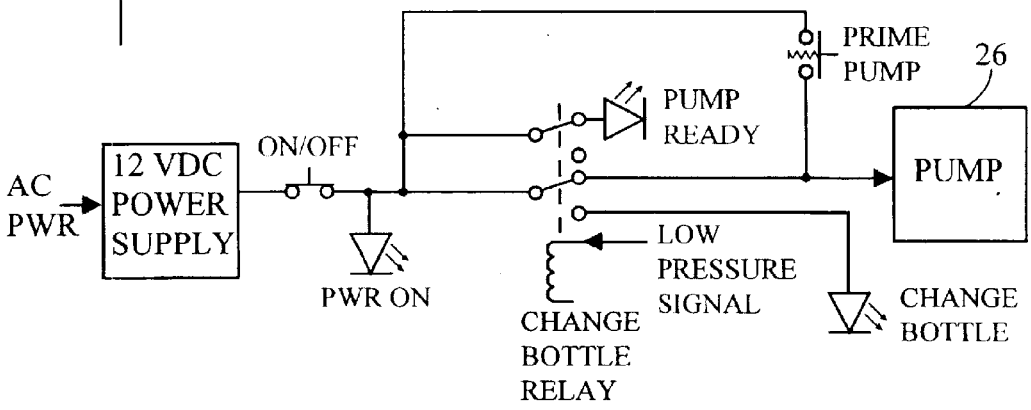
FIG. 6 is a simplified electrical schematic diagram.

FIG. 6 is a simplified electrical schematic diagram of supply system 20. A low pressure signal from pressure sensor 36 activates a change bottle relay, which in turn removes power to pump 26 and pump ready indicator, and provides power to the change bottle indicator causing that indicator to blink.

Figure 7:
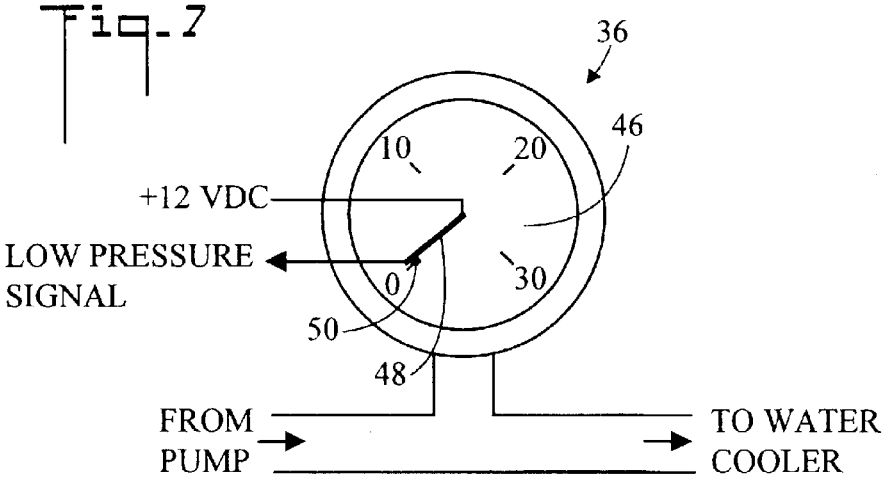
FIG. 7 is an enlarged view of a pressure sensor.

FIG. 7 is an enlarged view of one embodiment of pressure sensor 36. In this embodiment pressure sensor 36 includes a pressure gauge 46. 12 VDC is applied to one end of conductive needle 48. When low pressure is sensed, such as when air rather than water is pumped, the other end of needle 48 contacts a post 50, so that a low pressure signal is sent to the change bottle relay. It may be appreciated that other pressure sensors 36 could be utilized in the present invention.

Figure 8:
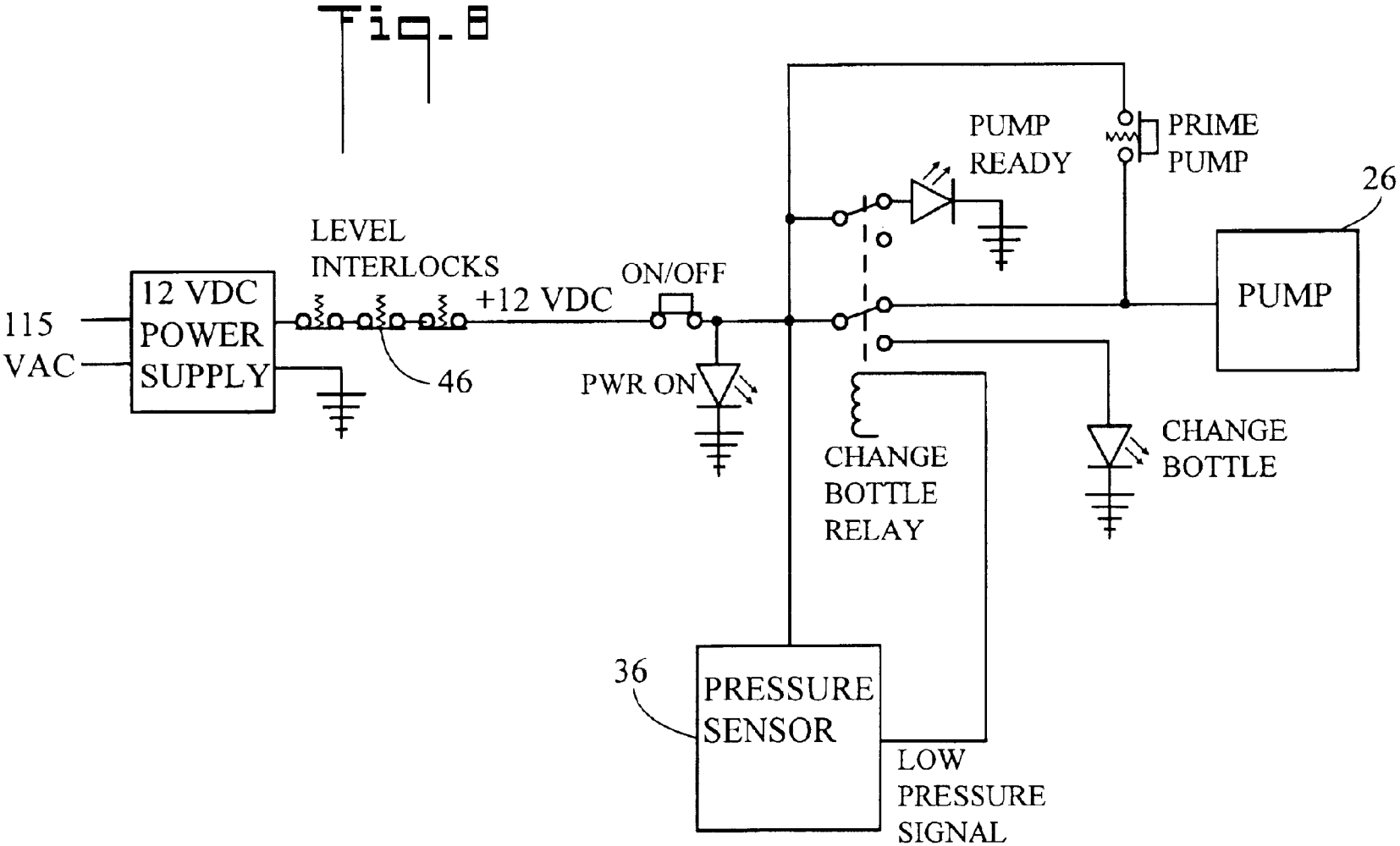
FIG. 8 is an electrical schematic diagram.

FIG. 8 is an electrical schematic diagram of supply system 20.

Figure 9:
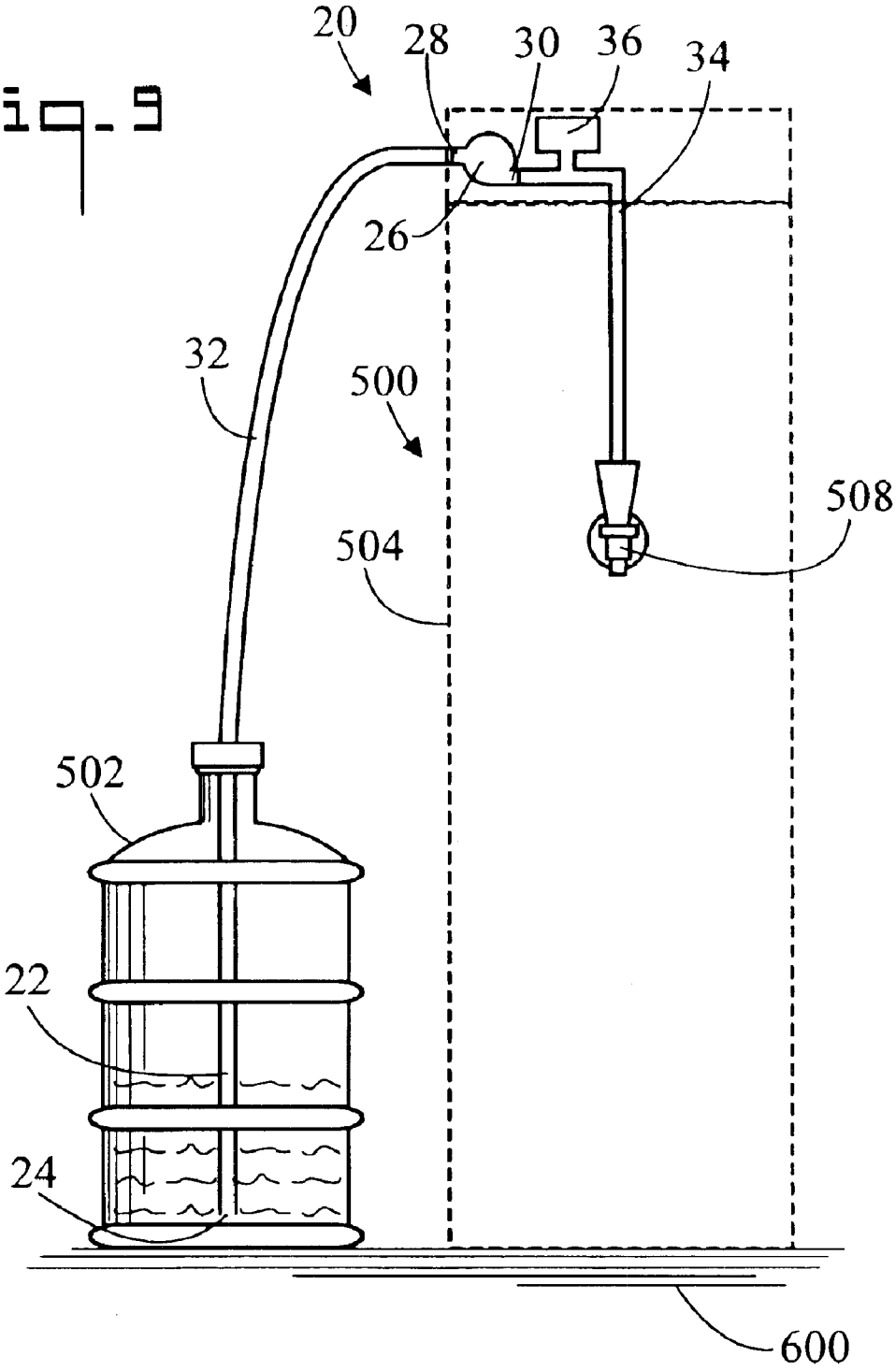
FIG. 9 is a front elevation view of water flow in a second embodiment of the bottled water cooler.

FIG. 9 is a front elevation view of water flow in a second embodiment of bottled water cooler 500. In this embodiment, bottle water cooler 500 does not contain a water reservoir. Rather water is routed from output 30 of pump 26 directly to faucet 508 via tube 34.

In terms of use, a method for supplying water to a bottled water cooler 500, includes:

(a) providing a bottled water cooler 500 including a bottle of water 502 residing in an upright position, a water reservoir 506, and at least one faucet 508 connected to water reservoir 506;

(b) providing a supply system 20 for bottled water cooler 500, supply system 20 including:

a hollow member 22 for removing water from bottle of water 502;

a pump 26 having an input 28 and an output 30, input 28 connected to hollow member 22, and output 30 connected by a tube 34 to water reservoir 506;

a pressure sensor 36 connected to tube 34, wherein pressure sensor 36 senses a pressure in tube 34;

a control panel 44 having an on/off control, a prime pump control, and a change bottle indicator;

(c) placing hollow member 22 into bottle of water 502;

(d) activating the on/off control and observing that the change bottle indicator is on;

(e) activating the prime pump control until the change bottle indicator turns off;

(f) deactivating the prime pump control; and, (g) using faucet 508 to dispense water from bottled water cooler 500.

The method further including:

(h) repeating step (g) until the change bottle indicator turns on;

(i) replacing bottle of water 502 with a new full bottle of water 502; and, (j) repeating steps (c) through (g).

Another method for supplying water to a bottled water cooler 500, includes:

(a) providing a bottled water cooler 500 including a bottle of water 502 residing in an upright position, and at least one faucet 508;

(b) providing a supply system 20 for bottled water cooler 500, supply system20 including:

a hollow member 22 for removing water from bottle of water 502;

a pump 26 having an input 28 and an output 30, input 28 connected to hollow member 22, and output 30 connected by a tube 34 to faucet 508;

a pressure sensor 36 connected to tube 34, wherein pressure sensor 36 senses a pressure in tube 34;

a control panel 44 having an on/off control, a prime pump control, and a change bottle indicator;

(c) placing hollow member 22 into bottle of water 502;

(d) activating the on/off control and observing that the change bottle indicator is on;

(e) activating the prime pump control until the change bottle indicator turns off;

(f) deactivating the prime pump control; and, (g) using faucet 508 to dispense water from bottled water cooler 500.

The method further including:

(h) repeating step (g) until the change bottle indicator turns on;

(i) replacing bottle of water 502 with a new full bottle of water 502; and, (j) repeating steps (c) through (g).

In a preferred embodiment of the invention, pump 26 is an automatic demand pump available from Shurflo of Santa Ana, Calif. 92706, part number 2088-422-444.

The preferred embodiments of the invention described herein are exemplary and numerous modifications, variations, and rearrangements can be readily envisioned to achieve an equivalent result, all of which are intended to be embraced within the scope of the appended claims.

I claim:

1. A supply system for a bottled water cooler, the bottled water cooler including a bottle of water residing in an upright position, a water reservoir, and at least one faucet connected to the water reservoir, said supply system comprising:

a hollow member for removing water from the bottle of water;

a pump having an input and an output, said input connected to said hollow member, and said output connected by a tube to the water reservoir;

a pressure sensor connected to said tube, wherein said pressure sensor senses a pressure in said tube; and, wherein when the bottle of water is empty, said pressure sensor sensing a low pressure and causing said pump to turn off;

said pump disposed in a housing having a bottom surface; and, at least one level interlock disposed on said bottom surface of said housing, so that if said bottom surface is not residing on a support surface, said interlock will cause said pump to turn off.

2. A supply system according to claim 1, further including:

a plurality of said level interlocks, said plurality being connected in series.

3. A supply system for a bottled water cooler, the bottled water cooler including a bottle of water residing in an upright position, a water reservoir, and at least one faucet connected to the water reservoir, said supply system comprising:

a hollow member for removing water from the bottle of water;

a pump having an input and an output, said input connected to said hollow member, and said output connected by a tube to the water reservoir;

a pressure sensor connected to said tube, wherein said pressure sensor senses a pressure in said tube; and, wherein when the bottle of water is empty, said pressure sensor sensing a low pressure and causing said pump to turn off;

a water level sensor connected to the water reservoir;

where in when a predetermined water level is attained in the water reservoir, said water level sensor blocking water flow from said output of said pump to the water reservoir;

a prime pump control for directly turning said pump on, thereby overriding said low pressure condition;

said pump disposed in a housing having a bottom surface;

said pressure sensor being a pressure guage;

at least one level interlock disposed on said bottom surface of said housing, so that if said bottom surface is not residing on a support surface, said interlock will cause said pump to turn off; and, a plurality of said level interlocks, said plurality being connected in series.

4. A method for supplying water to a bottled water cooler, comprising:

(a) providing a bottled water cooler including a bottle of water residing in an upright position, a water reservoir, and at least one faucet connected to said water reservoir;

(b) providing a supply system for said bottled water cooler, said supply system including:

a hollow member for removing water from said bottle of water;

a pump having an input and an output, said input connected to said hollow member, and said output connected by a tube to said water reservoir;

a pressure sensor connected to said tube, wherein said pressure sensor senses a pressure in said tube;

a control panel having an on/off control, a prime pump control, and a change bottle indicator;

(c) placing said hollow member into said bottle of water;

(d) activating said on/off control and observing that said change bottle indicator is on;

(e) activating said prime pump control until said change bottle indicator turns off;

(f) deactivating said prime pump control; and, (g) using said faucet to dispense water from said bottled water cooler.

5. The method of claim 4, further including:

(h) repeating step (g) until said change bottle indicator turns on;

(i) replacing said bottle of water with a new full bottle of water; and, (j) repeating steps (c) through (g).

6. A method for supplying water to a bottled water cooler, comprising:

(a) providing a bottled water cooler including a bottle of water residing in an upright position, and at least one faucet;

(b) providing a supply system for said bottled water cooler, said supply system including:

a hollow member for removing water from said bottle of water;

a pump having an input and an output, said input connected to said hollow member, and said output connected by a tube to said faucet;

a pressure sensor connected to said tube, wherein said pressure sensor senses a pressure in said tube;

a control panel having an on/off control, a prime pump control, and a change bottle indicator;

(c) placing said hollow member into said bottle of water;

(d) activating said on/off control and observing that said change bottle indicator is on;

(e) activating said prime pump control until said change bottle indicator turns off;

(f) deactivating said prime pump control; and, (g) using said faucet to dispense water from said bottled water cooler.

7. The method of claim 6, further including:

(h) repeating step (g) until said change bottle indicator turns on;

(i) replacing said bottle of water with a new full bottle of water; and, (j) repeating steps (c) through (g).

* * * * *